US009136650B2

(12) United States Patent
Xuan et al.

(10) Patent No.: US 9,136,650 B2
(45) Date of Patent: Sep. 15, 2015

(54) ELECTRICAL CONNECTOR

(71) Applicant: HON HAI PRECISION INDUSTRY CO., LTD., New Taipei (TW)

(72) Inventors: Wan-Li Xuan, Kunshan (CN); Huan Chen, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/243,135

(22) Filed: Apr. 2, 2014

(65) Prior Publication Data

US 2014/0295696 A1 Oct. 2, 2014

(30) Foreign Application Priority Data

Apr. 2, 2013 (CN) ..... 2013 1 01117215

(51) Int. Cl.

| | |
|---|---|
| ***H01R 13/6591*** | (2011.01) |
| ***H01R 13/6586*** | (2011.01) |
| ***H01R 13/66*** | (2006.01) |
| ***H01R 13/6466*** | (2011.01) |
| ***H01R 13/6587*** | (2011.01) |
| ***H01R 24/64*** | (2011.01) |
| *H01R 13/717* | (2006.01) |
| *H01R 13/6594* | (2011.01) |

(52) U.S. Cl.

CPC ..... *H01R 13/6586* (2013.01); *H01R 13/6466* (2013.01); *H01R 13/6587* (2013.01); *H01R 13/6633* (2013.01); *H01R 24/64* (2013.01); *H01R 13/6594* (2013.01); *H01R 13/7175* (2013.01)

(58) Field of Classification Search

CPC ..... H01R 13/6587; H01R 13/6586

See application file for complete search history.

(56) References Cited

U.S. PATENT DOCUMENTS

| | | | | |
|---|---|---|---|---|
| 6,083,047 | A * | 7/2000 | Paagman | 439/607.07 |
| 6,168,469 | B1 * | 1/2001 | Lu | 439/607.01 |
| 6,227,911 | B1 * | 5/2001 | Boutros et al. | 439/620.18 |
| 6,347,962 | B1 * | 2/2002 | Kline | 439/607.07 |
| 6,666,694 | B1 * | 12/2003 | Daly et al. | 439/79 |
| 6,932,649 | B1 * | 8/2005 | Rothermel et al. | 439/620.01 |
| 7,357,673 | B2 | 4/2008 | Long | |
| 8,007,318 | B1 | 8/2011 | Dunwoody et al. | |
| 8,475,209 | B1 * | 7/2013 | Whiteman et al. | 439/607.07 |
| 2004/0018776 | A1 * | 1/2004 | Padro et al. | 439/701 |
| 2005/0032430 | A1 * | 2/2005 | Otsu et al. | 439/608 |
| 2005/0208831 | A1 * | 9/2005 | Lee | 439/608 |
| 2011/0294356 | A1 * | 12/2011 | Mizukami et al. | 439/660 |
| 2012/0196478 | A1 | 8/2012 | Zhang et al. | |
| 2014/0295696 | A1 * | 10/2014 | Xuan et al. | 439/488 |

* cited by examiner

*Primary Examiner* — James Harvey

(74) *Attorney, Agent, or Firm* — Ming Chieh Chang; Wei Te Chung

(57) ABSTRACT

An electrical connector includes an insulative housing having a pair of docking ports for receiving plug connectors, an insulative housing having the docking ports, a pair of contact modules mounted in the housing, and a shielding wafer. Each of the contact modules includes an insulative carrier, an inner printed circuit board mounted on the insulative carrier, a number of mating contacts extending from the inner printed circuit board into one of the docking ports and a number of mounting contacts connecting the inner printed circuit board with an exterior substrate, each of the insulative carriers defining a gap at a side proximal to an insulative carrier. The shielding wafer downwardly extending beyond the inner printed circuit board and fully shielding the contact modules, the shielding wafer is soldered at the gaps to the inner printed boards.

18 Claims, 9 Drawing Sheets

ELECTRICAL CONNECTOR

BACKGROUND OF THE INVENTION

1. Field of the Invention

The present invention relates to an electrical connector and especially relates to a shielding structure of the electrical connector.

2. Description of Related Art

An electrical connector 100' of a prior art design as shown in FIG. 1 has an insulative housing 1' having a number of mating ports for receiving plug connectors, a number of contact modules 2' mounted in the insulative housing 1' along a back-to-front direction, and a shielding wafer 3' disposed between the adjacent contact modules 2'. The shielding wafer 3' includes a metal plate 31' and an insulative part 30' overmolded with the metal plate 31'. The metal plate 31' includes a number of contact ribs 311' extending along two opposite transverse directions. The contact module 2' includes an insulative carrier 21' and a horizontal printed circuit board (PCB) 22' mounted on the insulative carrier 21'. Adjacent edges of the two insulative carriers 21' each have an access area or gap 223' for the contact rib 311' to be soldered on a PCB 22'. The shielding wafer 3' is provided to shield electrical magnetic interference (EMI) between adjacent contact modules 2'.

U.S. Pat. No. 8,007,318 discloses an electrical connector comprising a shielding shell, an insulative housing received in the shielding shell, an inner printed circuit board received in the shielding shell, a number of contact modules mounted on the inner printed circuit board, and a shielding blade disposed between two adjacent contact modules. The shielding blade has mounting tails and the inner printed circuit board has mounting holes receiving the mounting tails. The shielding blade shields adjacent contact modules, but corresponding inner printed circuit boards are not well shielded by the shielding blades.

An electrical connector having improved shielding effect is desired.

SUMMARY OF THE INVENTION

Accordingly, an object of the present invention is to provide an electrical connector having more shielding effective.

In order to achieve the object set forth, the invention provides an electrical connector comprising an insulative housing having a pair of docking ports, a pair of contact modules mounted in the insulative housing and a shielding wafer disposed between the adjacent contact modules. The contact module includes an insulative carrier defining a gap at a side proximal to an insulative carrier, an inner printed circuit board mounted on the insulative carrier, a number of mating contacts extending from the inner printed circuit board into one of docking ports, and a number of mounting contacts connecting the inner printed circuit board with an exterior substrate. The shielding wafer downwardly extends beyond the inner printed circuit board and fully shielding the contact modules. The shielding wafer is soldered at the gaps to the inner printed circuit boards.

Compared to existing designs, the shielding wafer of the electrical connector extends to the bottom of the contact module and fully shields adjacent inner printed circuit boards.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
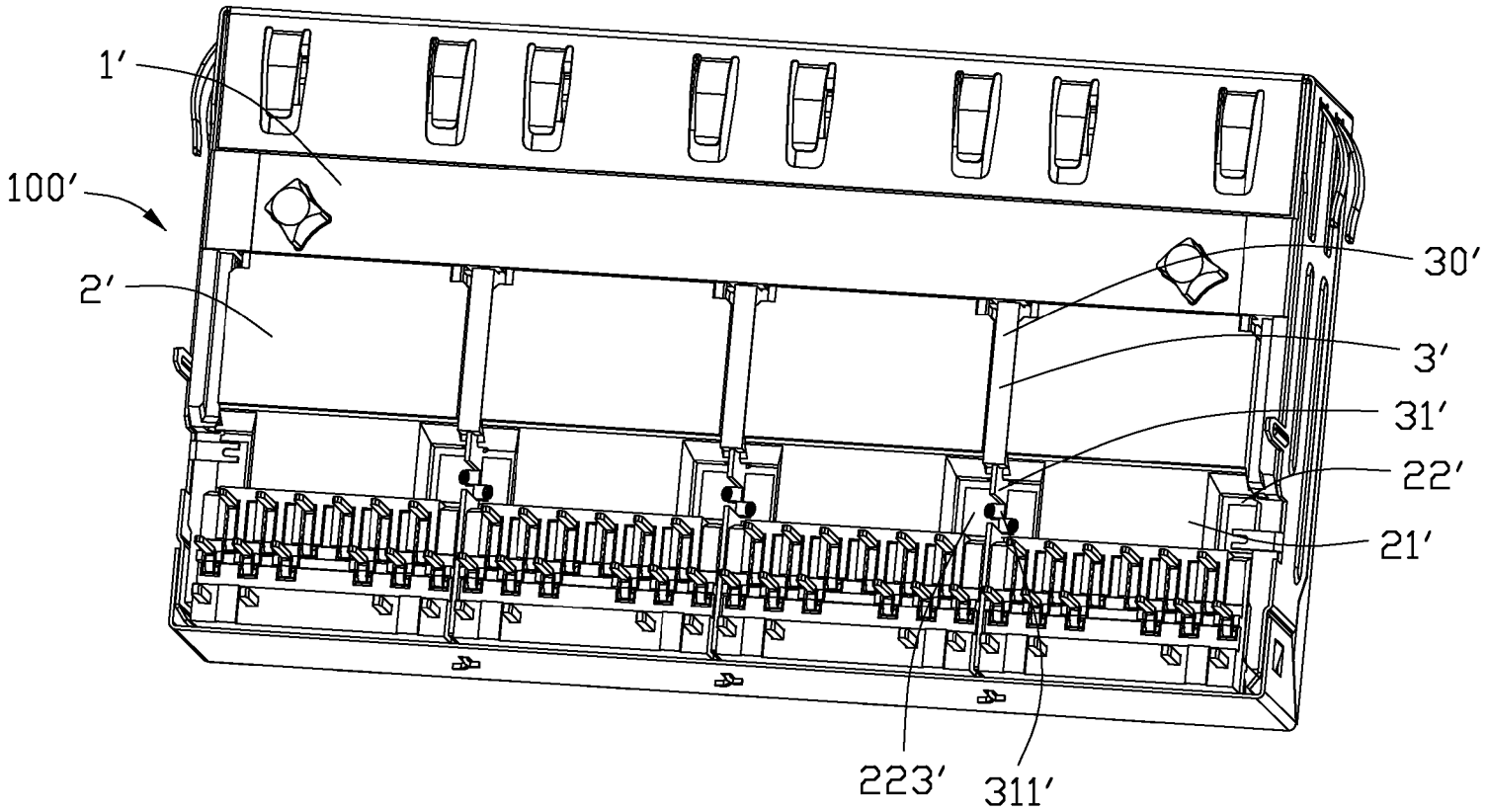
FIG. 1 (PRIOR ART)
FIG. 1 is a perspective view of an electrical connector of a prior art.
Figure 2:
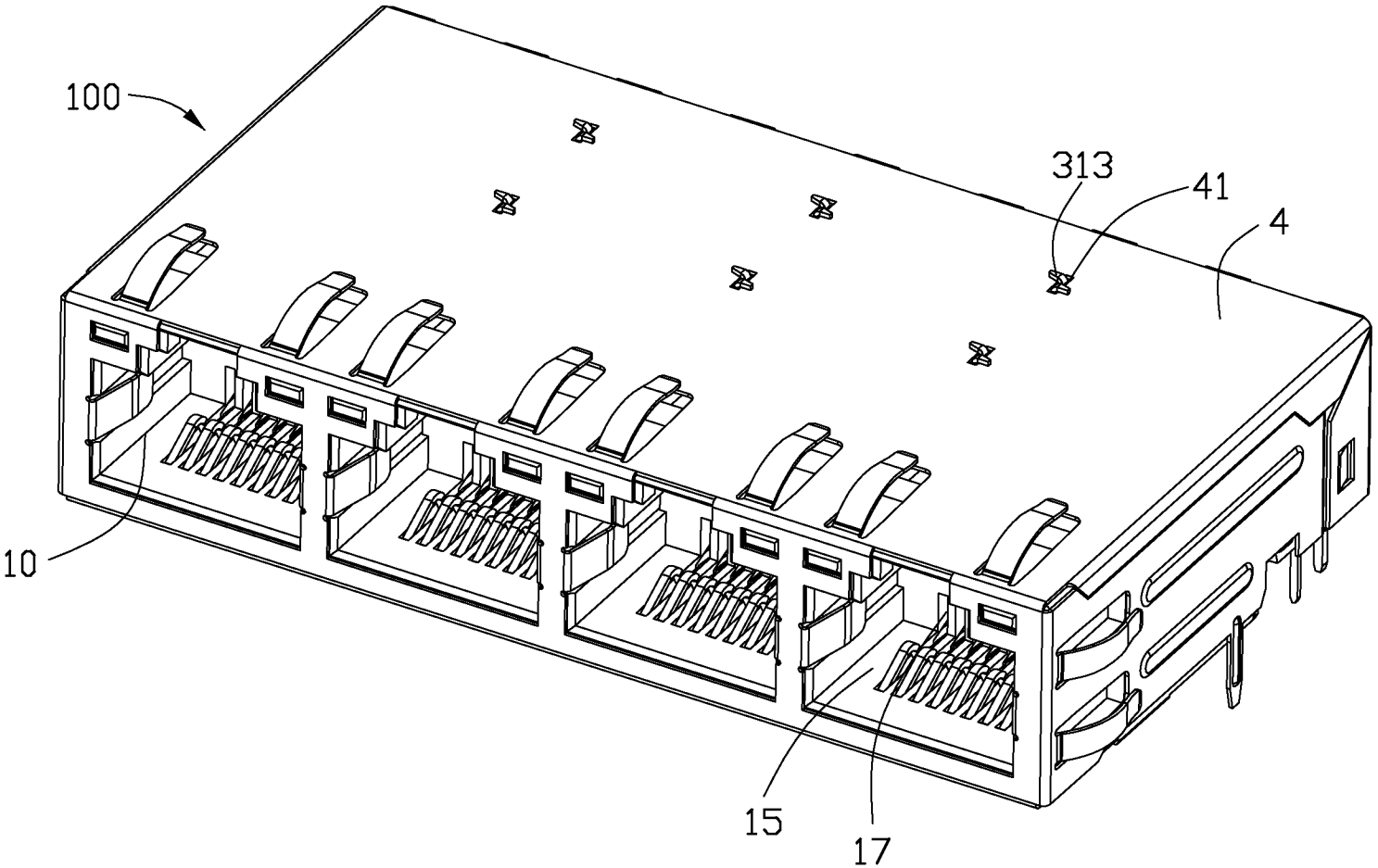
FIG. 2 is a perspective view of an electrical connector according to the present invention.
Figure 3:
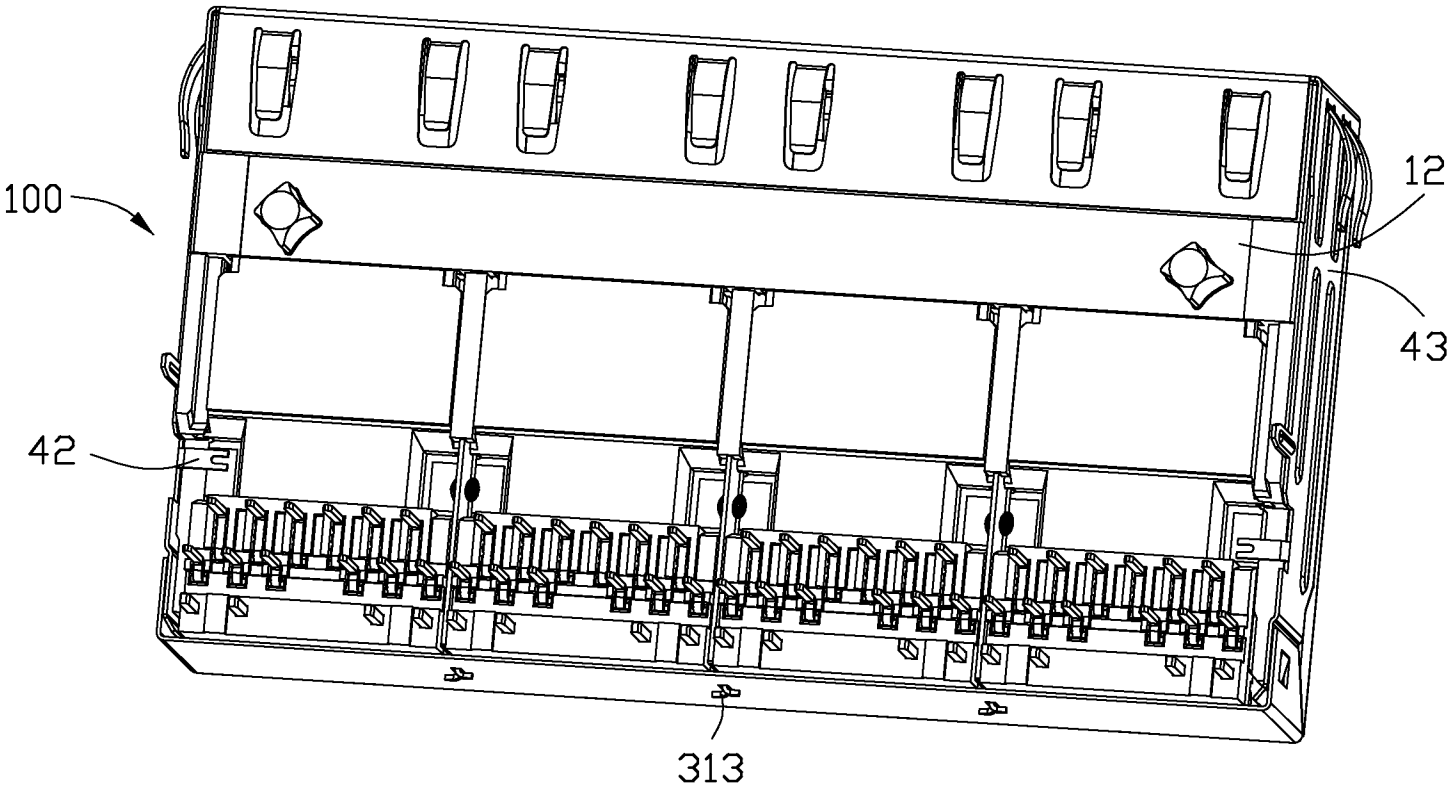
FIG. 3 is an another perspective view of an electrical connector shown in FIG. 2.
Figure 4:
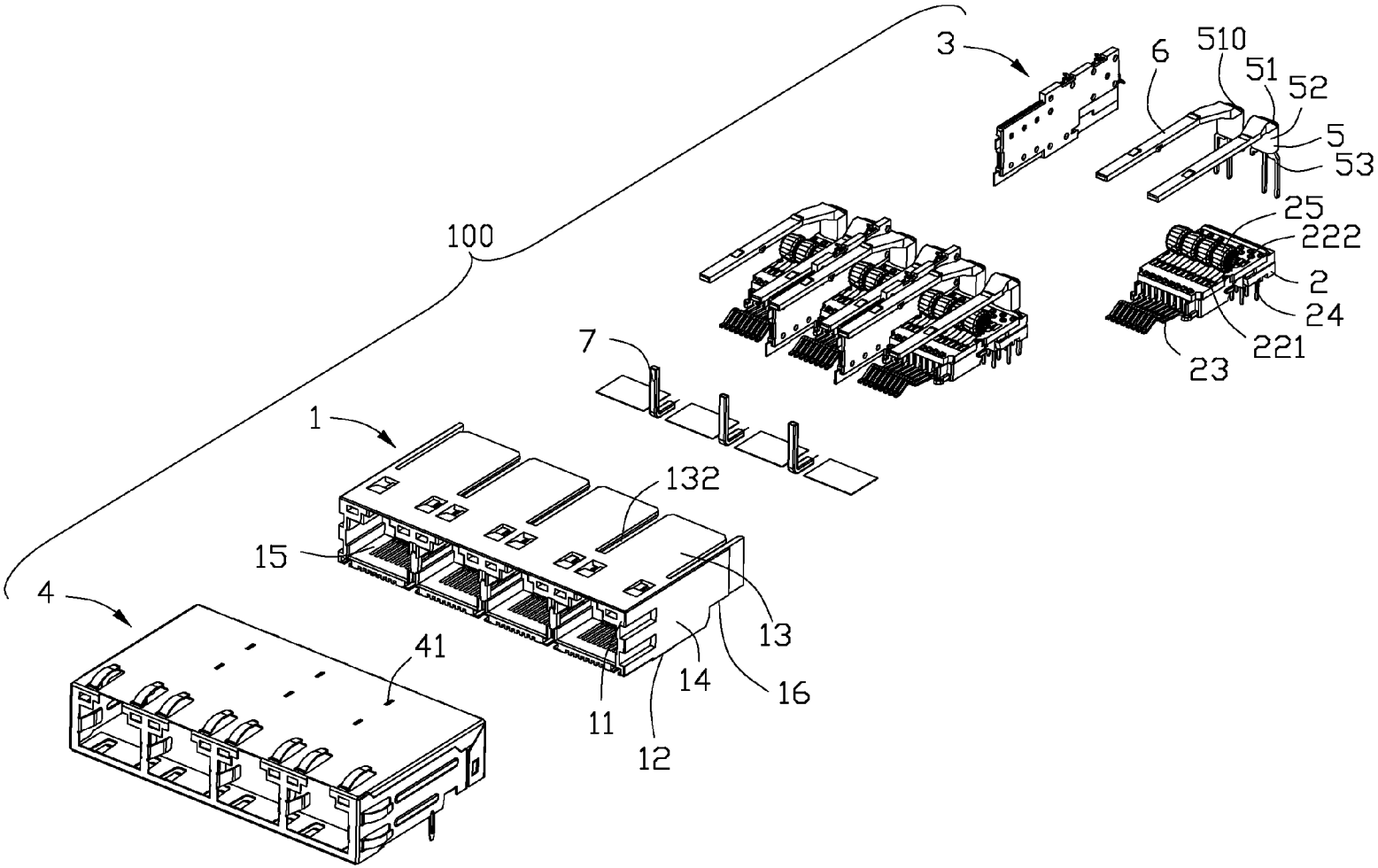
FIG. 4 is an exploded view of the electrical connector shown in FIG. 2.

Referring to FIGS. 2-4, a 1×4-ports electrical connector 100 (modular jack) according to the present invention is shown. The electrical connector 100 is adapted for being mounted on an exterior substrate and for mating with modular plugs. The electrical connector 100 has an insulative housing 1, a row of contact modules 2, a plurality of indicating assemblies, a shielding wafer 3, and a shielding shell 4. The shielding shell 4 encloses the insulative housing 1 and the contact modules 2. The shielding shell 4 is used for shielding electrical magnetic interference (EMI) from exterior environment.

The insulative housing 1 has a front wall 11 extending vertically along a transverse direction, a top wall 13 extending horizontally along a front-to-back direction, a lower wall 12 for being mounted to the exterior substrate, and a pair of side walls 14 extending vertically along the front-to-back direction. The insulative housing 1 defines a row of docking ports 15 for receiving modular plugs and a mounting port 16 disposed behind the mating ports 15. The mating ports 15 are recessed from the front wall 11 along the front-to-back direction. The mounting port 16 connects with the mating ports 15 through a plurality of passageway 17. The insulative housing further includes a number of slots 132 at the top wall 13 for receiving the shielding wafer 3.

Figure 8:
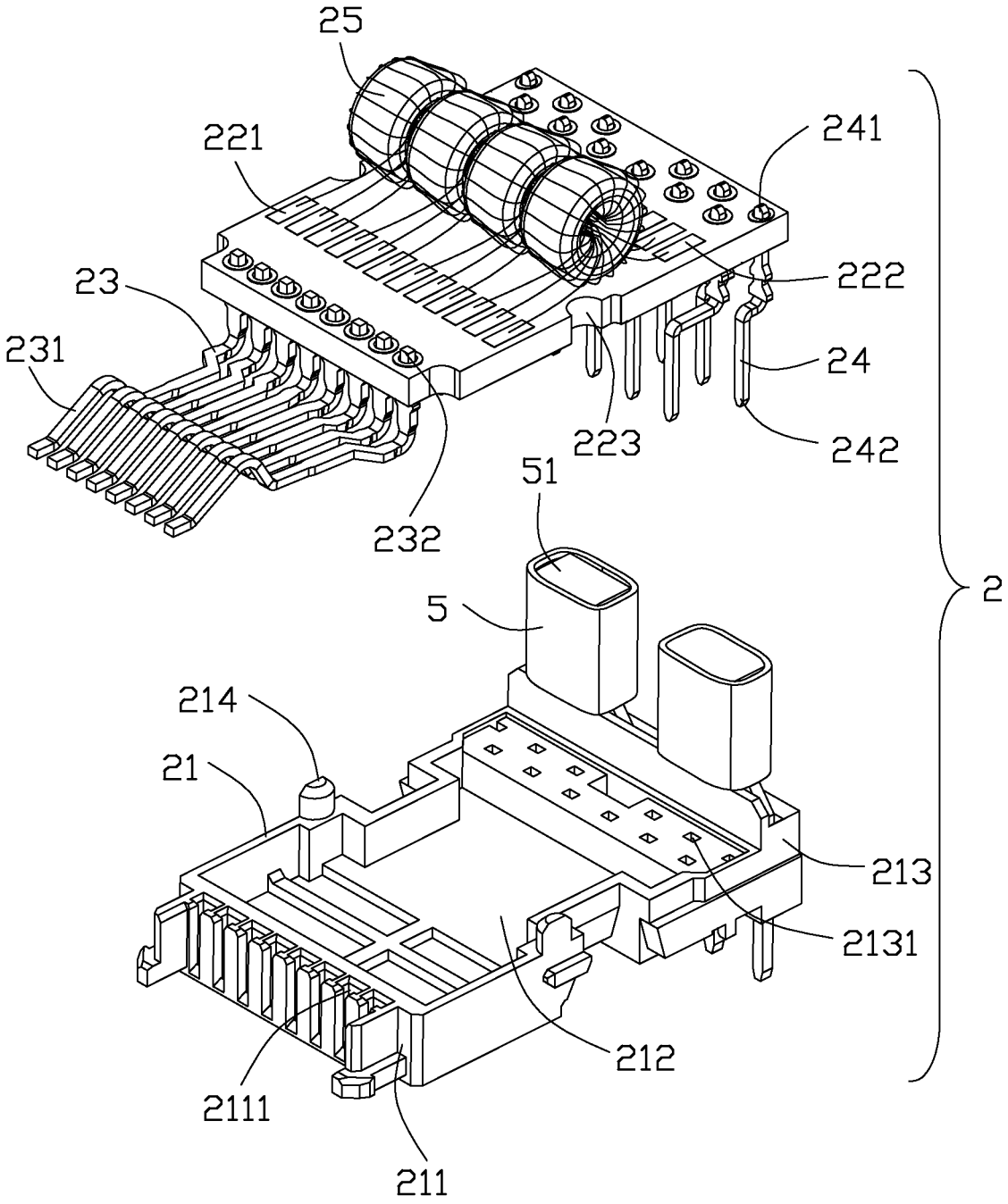
FIG. 8 is an exploded view of the contact module of the present invention.
Figure 9:
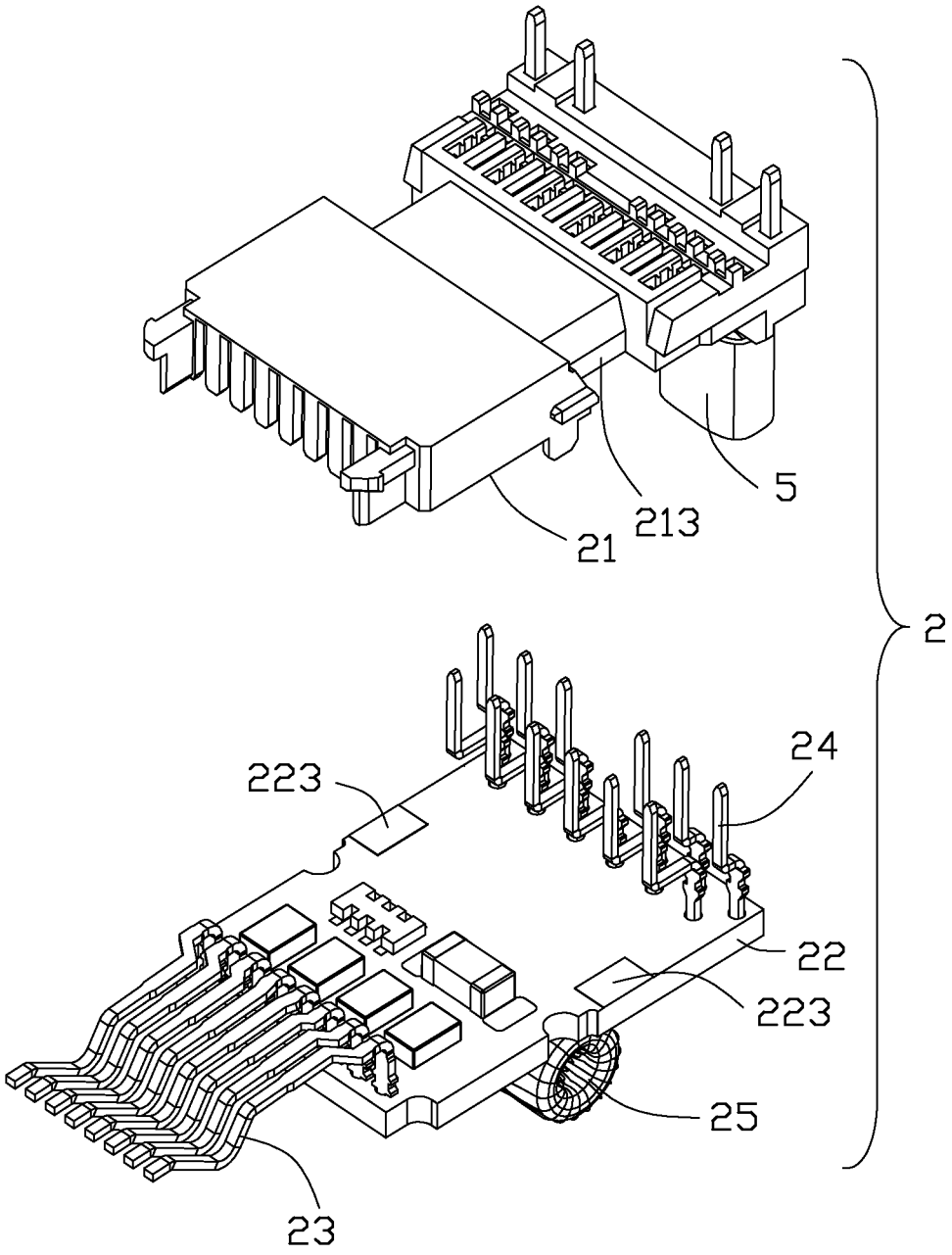
FIG. 9 is an another point exploded view of the contact module of the present invention.

Referring to FIGS. 8-9, the contact modules 2 are assembled to mounting port 16 along a back-to-front direction. The contact module 2 includes a horizontal printed circuit board (PCB) 22, a plurality of mating contacts 23 each having a contacting portion 231 extending into the mating port 15 and a connecting portion 232 connecting with the PCB 22, and a plurality of mounting contacts 24 each including a top portion 241 connected with the PCB 22 and a lower tail portion 242 exposed outside of the insulative housing 1. The PCB 22 has a front portion connected with contacting portions 231 of the mating contacts 23, a rear portion connecting with the top portions 241 of the mounting contacts 24, and a middle portion with two rows of conductive pads 221 for connecting with magnetic coils 25. The contact module 2 further includes an insulative carrier 21 disposed horizontally along the front-to-back direction for mounting the PCB 22. The insulative carrier 21 has a front section 211 for retaining the mating contacts 23, a rear section 213 for retaining the mounting contacts 24, and a cavity 212 opening upwardly and located between the front section 211 and the rear section 213. The front section 211 has a plurality of first retaining grooves 2111 extending along a top-to-bottom direction for retention of the mating contacts 23. The rear section 213 has a plurality of second retaining grooves 2131 for retention of the mounting contacts 24. The middle portion of the PCB 22 defines two side slots 223. The insulative carrier 21 has two position posts 214 extending upwardly for inserting in the two side slots 223, respectively.

The electrical connector 100 further includes a number of indicating assemblies. Each indicating assembly includes a light pipe 6 extending along the front-to-back direction and a light emitting diode (LED) 5 extending along the top-to-bottom direction. The light emitting diode 5 has a plurality of plural mounting pins 53, a light emitting portion 51, and an opaque layer 52 enclosing the light emitting 5. The mounting pins 53 mount on the exterior substrate through the insulative carrier 21.

Figure 5:
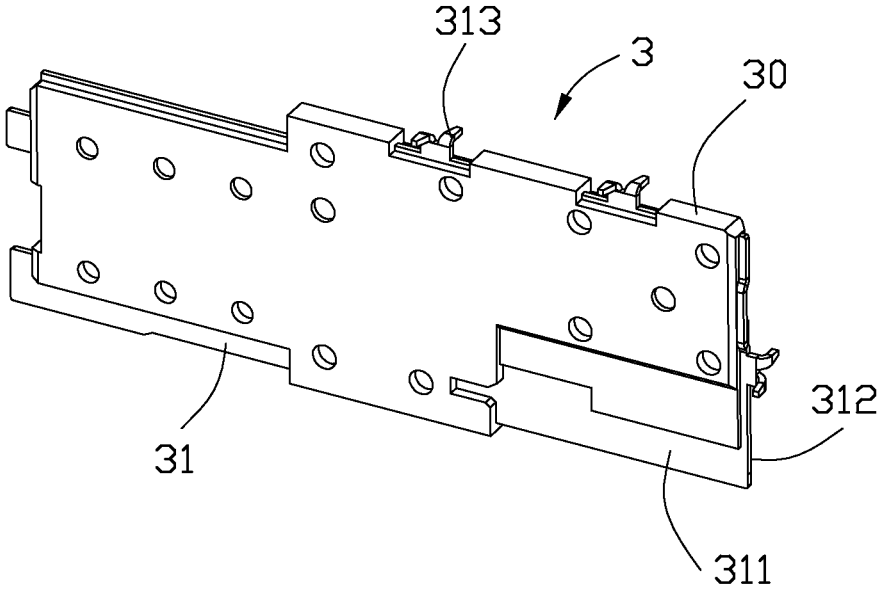
FIG. 5 is a perspective view of the shielding wafer of the electrical connector.
Figure 6:
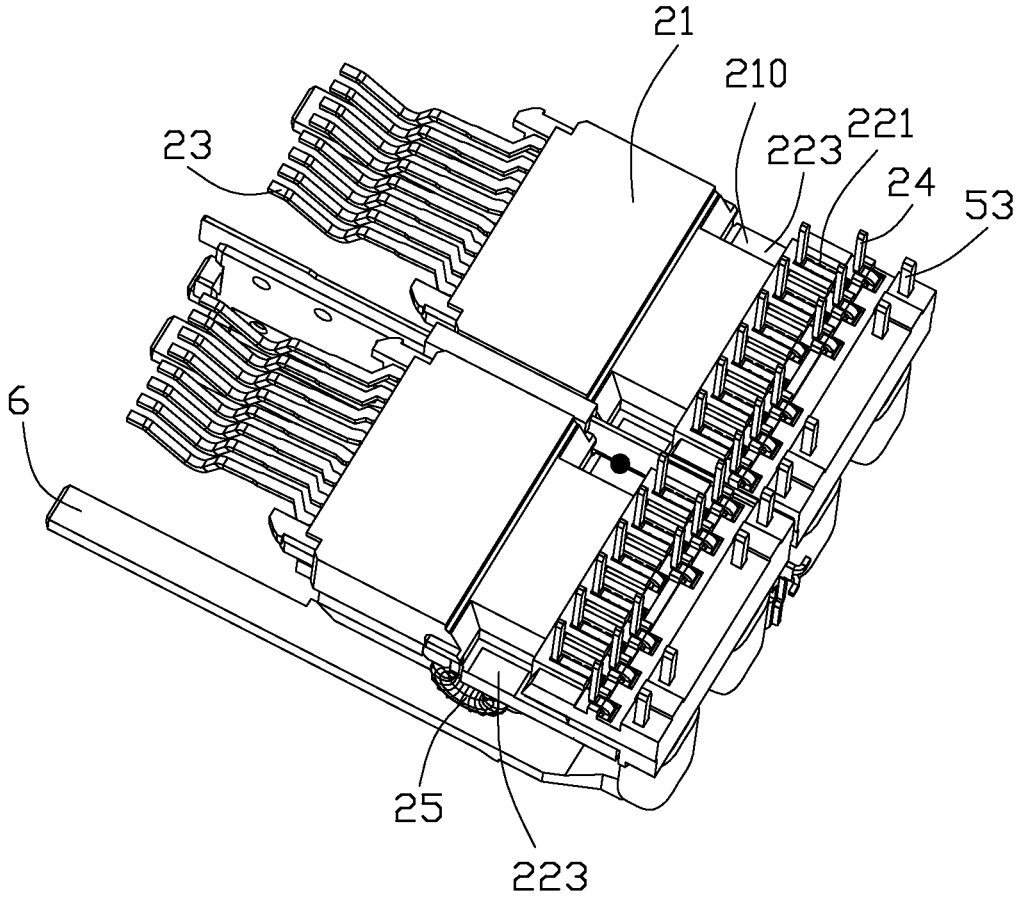
FIG. 6 is a perspective view of two contact modules soldering with the shielding wafer.
Figure 7:
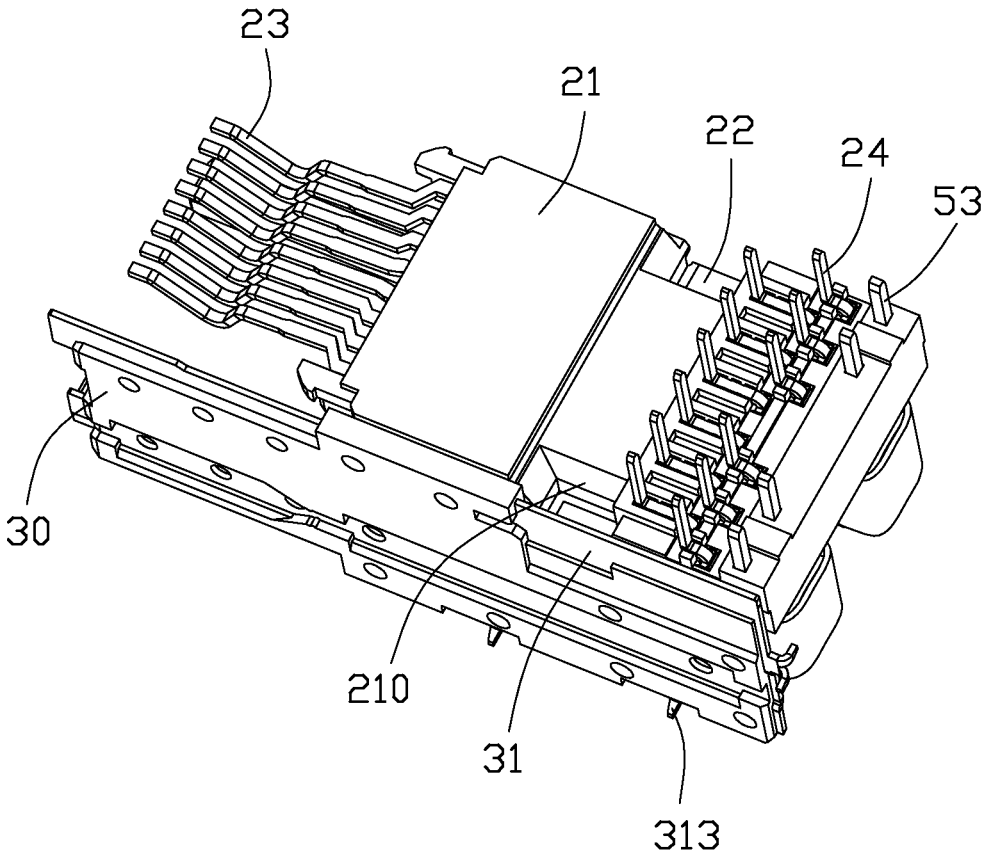
FIG. 7 is a perspective view of one contact module cooperating with the shielding wafer.

Referring to FIGS. 5-7, the shielding wafers 3 are used for shielding EMI between two adjacent contact modules 2. Each of the shielding wafers includes a metal plate 31 and an insulative part 30 over molding with the metal plate 31. The shielding wafer 3 downwardly extends beyond the inner PCB 22 to the same level as the bottom of the insulative carrier 21 and fully shields the contact modules 2. Therefore, the shielding structure makes shielding effect better. The insulative carrier 21 defines gaps 210 at two sides. The shelling wafer 3 defines a first side 311 and a second side 312 opposite to the first side 311. A welding torch enters into a gap 210 to solder the first side 311 with the ground conductive pad 223 of the inner PCB 22 adjacent to the first side 311. A welding tool or torch enters into the other gap 210 to solder the second side 312 with the ground conductive pad 223 of the inner PCB 22 adjacent to the second side 312. The inner printed circuit board 22 of one contact module 2 is separated from the inner PCB 22 of the other adjacent contact module 2. The metal plate 31 has a number of retention ribs 313 upwardly and backwardly extending beyond the insulative part 30.

Referring to FIG. 2, the shielding shell 4 has a number of retention holes 41 in the top wall. The retention ribs 313 are riveted to the shielding shell 4 through corresponding retention holes 41. Referring to FIG. 3, the shielding shell 4 has two side walls 43 and a solder tail 42 extending from one side wall 43. Each insulative carrier 21 has two gaps 210 in two sides. Each solder tail 42 is soldered to the ground conductive pads 223 in a gap 210 that close to one side wall 43. Referring to FIG. 4, the electrical connector 100 further includes a number of conductive foams 7 having resilience and a good conductive effect. The conductive foams 7 are mounted in front of the shielding wafer 3 and the shielding wafer 3 presses the shielding shell 4. The conductive foams 7 are extruded. Therefore, the metal plates 31 are firmly connected to the shielding shell 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a pair of docking ports each for receiving a plug connector, the docking port extending along a front-to-back direction;

an insulative housing receiving the docking ports;

a pair of contact modules mounted in the housing, each of the contact modules comprising an insulative carrier, an inner printed circuit board mounted on the insulative carrier, a plurality of mating contacts extending from the inner printed circuit board into one of the docking ports, and a plurality of mounting contacts connecting the inner printed circuit board with an exterior substrate, each of the insulative carriers defining a gap at a side proximal to an adjacent insulative carrier; and a shielding wafer downwardly extending beyond the inner printed circuit board and fully shielding the contact modules, wherein the shielding wafer is soldered at the gaps to the inner printed boards.

2. An electrical connector comprising:

an insulative housing defining a pair of mating ports side by side arranged with each other in a transverse direction;

a pair of contact modules corresponding to the pair of mating ports in a front-to-back direction perpendicular to said transverse direction, each of said contact modules including an insulative carrier and an inner printed circuit board seated upon the insulative carrier;

a plurality of front contacts retained in a front portion of the carrier with front contacting sections extending into the mating port and rear connecting sections mounted to a front region of the printed circuit board;

a plurality of rear contacts retained in a rear portion of the carrier with upper sections mounted to a rear region of the printed circuit board and lower sections extending downwardly for mounting to an external printed circuit board; wherein the front portion of the carrier includes a plurality of vertical grooves, and each of said front contacts includes a vertical section retained in the corresponding vertical groove.

3. The electrical connector as claimed in claim 1, further comprising a shielding shell having a retention hole, and wherein the metal plate has a plurality of retention ribs extending beyond the insulative part and received by the retention hole.

4. The electrical connector as claimed in claim 3, wherein the shielding shell having two side walls and a solder tail extending from each side wall, each edge of the insulative carrier close to one side wall also having a gap, the solder tail is soldered with the inner printed circuit board in the gap.

5. The electrical connector as claimed in claim 1, wherein each of the contact modules comprises a plurality of magnetic coil mounted on the inner printed circuit board, the inner printed circuit board has a plurality of conductive pads electrically connected with the magnetic coil, and the mounting contacts are disposed behind the conductive pad and extend from the inner printed circuit board through the insulative carrier.

6. The electrical connector as claimed in claim 5, wherein each of the insulative carriers comprises a plurality of grooves, and the mounting contacts bend forward from the bottom surface of the insulative carrier and are received in the grooves.

7. The electrical connector as claimed in claim 1, further comprising a plurality of light emitting diodes, each of the light emitting diodes comprising a light emitting portion and an opaque layer enclosing the light emitting portion.

8. The electrical connector as claimed in claim 7, wherein the light emitting diode comprises plural mounting pins mounted in the insulative carrier.

9. The electrical connector as claimed in claim 1, wherein the insulative housing has a slot receiving the shielding wafer.

10. An electrical connector comprising:

an insulative housing defining a pair of mating ports side by side arranged with each other in a transverse direction;

a pair of contact modules corresponding to the pair of mating ports in a front-to-back direction perpendicular to said transverse direction, each of said contact modules including an insulative carrier and an inner printed circuit board seated upon the insulative carrier;

a plurality of front contacts retained in a front portion of the carrier with front contacting sections extending into the mating port and rear connecting sections mounted to a front region of the printed circuit board;

a plurality of rear contacts retained in a rear portion of the carrier with upper sections mounted to a rear region of the printed circuit board and lower sections extending downwardly for mounting to an external printed circuit board;

a vertical shielding wafer located between the pair of contact modules; and the inner printed circuit board forms a grounding pad intimately adjacent to the shielding wafer with soldering therebetween, and the carrier forms a gap in aligned with said grounding pad in a vertical direction perpendicular to both said transverse direction and said front-to-back direction, and the shielding wafer extends downwardly to shield said gap in the transverse direction.

11. The electrical connector as claimed in claim 2, wherein a pitch among the rear connecting sections of the front contacts is larger than that among the front contacting sections thereof.

12. The electrical connector as claimed in claim 2, wherein a plurality of magnets with coils thereon are located upon the inner printed circuit board opposite to the carrier.

13. The electrical connector as claimed in claim 10, wherein the lower section of the rear contact defines an L-shape configuration with a vertical segment for mounting to the external printed circuit board and a horizontal segment seated within a corresponding slot in the carrier.

14. The electrical connector as claimed in claim 2, wherein the inner printed circuit board forms a grounding pad intimately adjacent to the shielding wafer with soldering therebetween, and the carrier forms a gap in aligned with said grounding pad in a vertical direction perpendicular to both said transverse direction and said front-to-back direction, and the shielding wafer extends downwardly to shield said gap in the transverse direction.

15. The electrical connector as claimed in claim 2, wherein the rear portion of the carrier forms a plurality of retaining through slots in which the corresponding rear contacts are retained.

16. The electrical connector as claimed in claim 2, wherein the carrier defines a receiving cavity in which electronic components mounted upon the inner printed circuit board are received.

17. The electrical connector as claimed in claim 10, wherein the front portion of the carrier includes a plurality of vertical grooves, and each of said front contacts includes a vertical section retained in the corresponding vertical groove.

18. The electrical connector as claimed in claim 10, wherein a pitch among the rear connecting sections of the front contacts is larger than that among the front contacting sections thereof.

* * * * *